US006901976B1

(12) United States Patent
Bautista et al.

(10) Patent No.: US 6,901,976 B1
(45) Date of Patent: Jun. 7, 2005

(54) DEVICE FOR RECEIVING SALIVA EXPECTORATED BY A TOBACCO CHEWER

(76) Inventors: Anthony Bautista, 7916 La Riviera Dr., Apt. 274, Sacramento, CA (US) 95826; Brian Goodell, 880 Inverness Ct., Brentwood, CA (US) 94583

( * ) Notice: Subject to any disclaimer, the term of this patent is extended or adjusted under 35 U.S.C. 154(b) by 0 days.

(21) Appl. No.: 10/657,887

(22) Filed: Sep. 9, 2003

(51) Int. Cl.[7] ..... B65B 39/00
(52) U.S. Cl. ..... 141/340; 141/333; 141/338; 141/339
(58) Field of Search ..... 141/331–345, 141/375; 4/258

(56) References Cited

U.S. PATENT DOCUMENTS 5,140,711 A * 8/1992 Johnson ..... 4/258
5,415,210 A * 5/1995 Hannah ..... 141/333
5,647,415 A * 7/1997 Onders et al. ..... 141/331

* cited by examiner

*Primary Examiner*—Timothy L. Maust
(74) *Attorney, Agent, or Firm*—Thomas R. Lampe

(57) ABSTRACT

A device is positioned on the top of a beverage can for receiving saliva expectorated by a tobacco chewer and directing the saliva into the can. The device incorporates structure making the combination of container and can spill resistant.

15 Claims, 2 Drawing Sheets

DEVICE FOR RECEIVING SALIVA EXPECTORATED BY A TOBACCO CHEWER

TECHNICAL FIELD

This invention relates to a device utilized to receive and store saliva expectorated by an individual chewing tobacco.

BACKGROUND OF THE INVENTION

Chewing tobacco is a relatively common activity and has been for decades. A by-product of tobacco chewing is the formation of saliva incorporating at least some of the masticated tobacco product. Swallowing such saliva can make one ill so it is a common practice to spit the saliva into a container. Cuspidors or spittoons were commonly found in public places of business and even residences for this purpose in years past. Today however, a tobacco chewer must find his own way to remedy the problem.

Many chewers are in the habit of employing beverage cans for such purpose. There are, however, drawbacks to this approach. Not only does the typical beverage can have a relatively small opening, making it difficult to avoid making a mess on the top of the can, a beverage can, when on a floor or other support between uses by the tobacco chewer, can readily be knocked over, causing saliva in the can or saliva on the can to spill.

DISCLOSURE OF INVENTION

The present invention provides a device enabling a beverage can to be utilized in a more efficient and expeditious manner to act as a repository for saliva expectorated by a tobacco chewing individual. Utilizing the arrangement of this invention, virtually all of the saliva is directed to the interior of the can and does not rest on the top of the can. In addition, the device disclosed and claimed herein resists spilling from the beverage can when it is tipped over.

The device is utilized in combination with a beverage container such as a soda or beer can of conventional construction and including a side wall having an upper rim, a top attached to the upper rim and a bottom. The top, the side wall and the bottom define a beverage container interior and the top defines an opening disposed inwardly of the rim and communicating with the beverage container interior.

The device is for receiving saliva expectorated by a tobacco chewing individual and directing the saliva into the beverage container interior.

The device includes an open topped receptacle having an outlet and a connector releasably connecting the receptacle to the beverage container with the outlet in liquid flow communication with the opening defined by the top of the beverage container whereby saliva in the receptacle will drain under the influence of gravity into the beverage container interior.

The device additionally includes a drain conduit attached to the open topped receptacle and extending downwardly therefrom. The drain conduit extends into the beverage container interior and defines a liquid flow passageway in liquid flow communication with the outlet of the receptacle.

Other features, advantages and objects of the present invention will become apparent with reference to the following description and accompanying drawings.

BEST MODE FOR CARRYING OUT THE INVENTION

Figure 1:
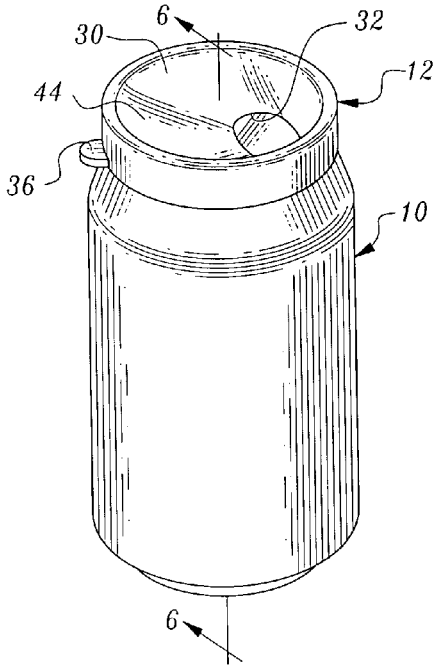
FIG. 1 is a perspective view illustrating a preferred embodiment of the device constructed in accordance with the teachings of the present invention releasably connected to the top of a beverage container in the form of a beverage can.
Figure 2:
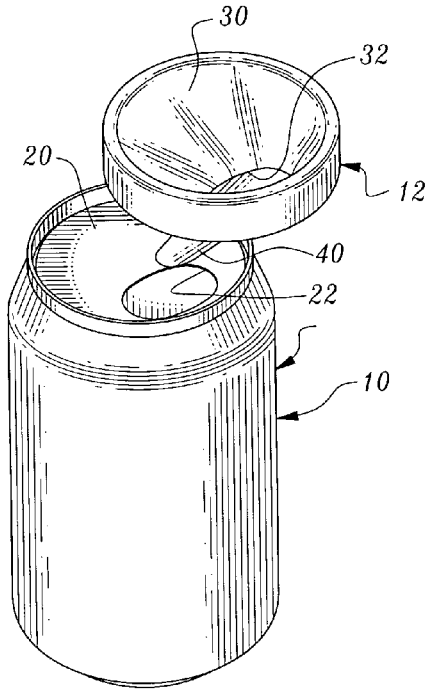
FIG. 2 is a perspective view illustrating the device prior to its application to the beverage can.
Figure 3:
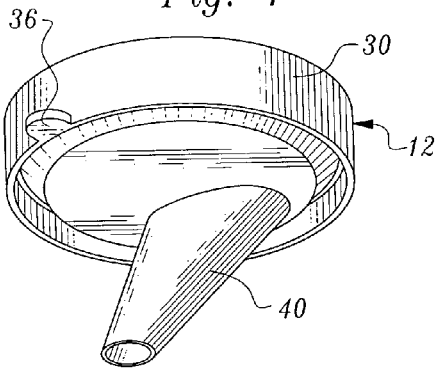
FIG. 3 is a bottom, perspective view of the device.
Figure 5:
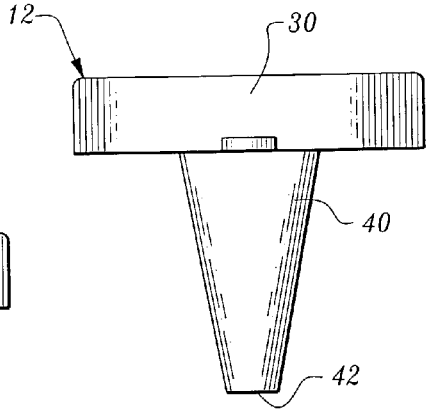
FIG. 5 is a frontal, elevational view of the device.
Figure 4:
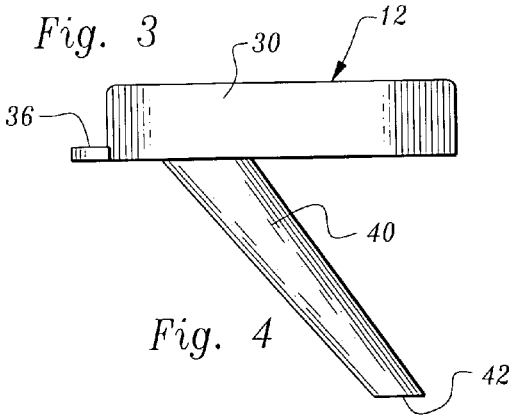
FIG. 4 is a side, elevational view of the device.

Referring now to the drawings, a conventional beverage container in the form of a "pop top" beverage can 10 is illustrated.

The beverage can includes a side wall 14 having an upper rim 16, a bottom 18 and a top 20. The top, the side wall and the bottom define a beverage container interior. The top defines an opening 22 which communicates with the beverage container interior and which was formed prior to consumption of the beverage in the container by removal of the "pop top" closure of well known construction.

Figure 6:
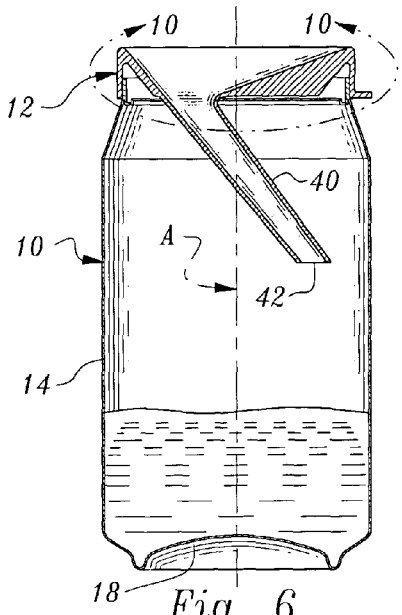
FIG. 6 is a cross-sectional view taken along the line 6—6 in FIG. 1.

The can has a central longitudinal axis A (see FIG. 6) and the opening 22 is off center in the top, located off to one side of the central longitudinal axis A and within the confines of the rim 16. The device 12 is for receiving saliva expectorated by a tobacco chewing individual and for directing the saliva into the interior of the beverage can 10.

Figure 10:
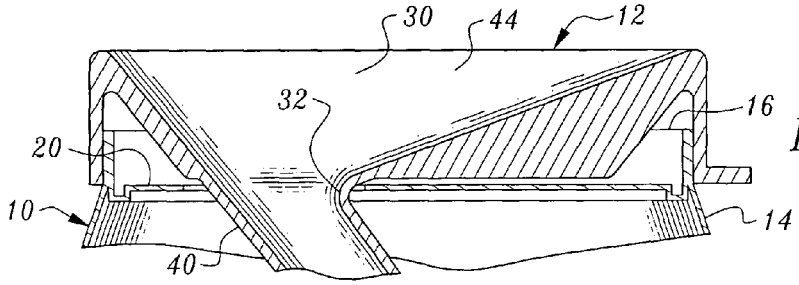
FIG. 10 is an enlarged, cross-sectional view taken along the line 10—10 in FIG. 6.

The device 12 includes an open topped receptacle 30 having an outlet 32. Surrounding the receptacle is a connector for releasably connecting the receptacle to the beverage container with the outlet 32 in liquid flow communication with the opening 22 whereby saliva in the receptacle will drain under the influence of gravity into the beverage container interior. More particularly, the connector is in the form of an outer sleeve or skirt 34 which surrounds and frictionally engages the rim 16 (as may perhaps best be seen with reference to FIG. 10) when the device is in position on the can. A manually engageable tab 36 projects from the skirt or sleeve 34 to facilitate installation and removal of the device.

The device also includes a drain conduit 40 attached to the receptacle 30 and extending downwardly therefrom. The drain conduit extends into the beverage container interior and defines a liquid flow passageway in communication with the outlet 32 of the receptacle 30. The drain conduit 40 has an open distal end 42 located in the beverage can interior and spaced from the bottom 18, side wall 14, and top 20. The drain conduit is rigid and defines an acute angle with the top of the beverage container and the receptacle. Saliva engaging the inclined inner wall 44 of receptacle 30 will be directed to the outlet 32 since the wall surface 42 converges at the outlet. From the outlet, the saliva will be directed to the open distal end 42 of the drain conduit and thence flow into the can interior. In the arrangement illustrated, the device 12 is of integral, molded plastic construction, however other construction approaches and materials may be utilized when practicing the teachings of this invention.

Figure 7:
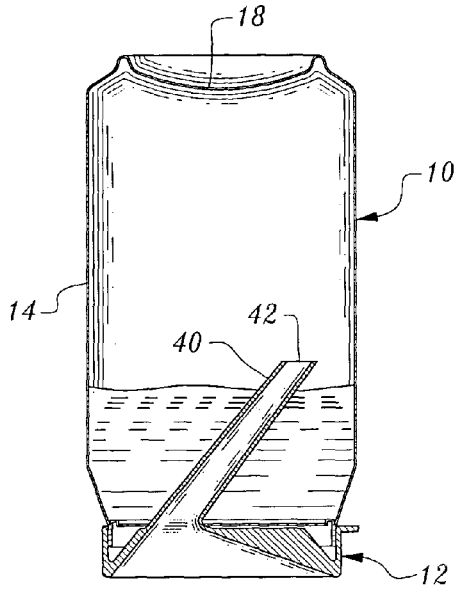
FIG. 7 is a view similar to FIG. 6, but illustrating the beverage container and device in an upside down condition.
Figure 8:
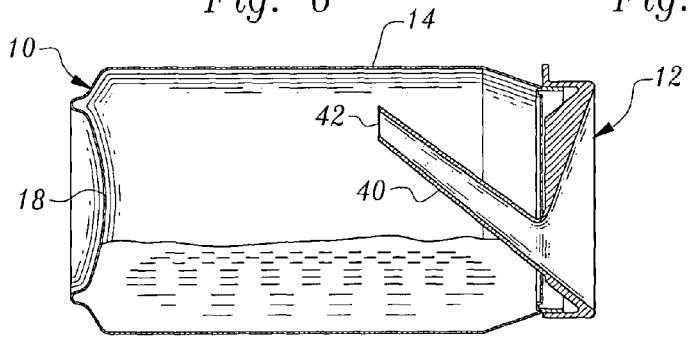
FIG. 8 is a view similar to FIG. 6, but showing the beverage container lying on its side with the drain conduit of the device inclined upwardly.
Figure 9:
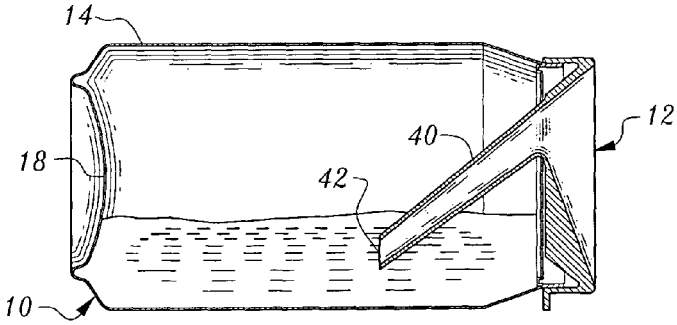
FIG. 9 is a view similar to FIG. 8, but showing the beverage container lying on its side and the drain conduit inclined downwardly.

It should be noted that when the device is in position in the can, the cross-section of the drain conduit 40 at the location of opening 22 conforms to the shape of that opening. This not only adds to the stability of the device on the can but prevents passage of saliva between the can and the drain conduit in the event the can is tipped over. The open distal end of the inclined drain conduit 40 is at a location in the beverage can interior on a side of the longitudinal central axis A opposed to the side of the longitudinal central axis occupied by opening 22 and outlet 32. This configuration of the drain conduit results in an arrangement which makes the combination of the can and device spill resistant. In FIG. 7, spillage of the contents of the can is prevented even though the can and the device are upside down. FIGS. 8 and 9 show two different orientations in which the can is lying on its side. In neither case does saliva escape from the can interior through the device.

The invention claimed is:

1. In combination:

a beverage container including a side wall having an upper rim, a top attached to said upper rim, and a bottom, said top, said side wall and said bottom defining a beverage container interior, and said top defining an opening disposed inwardly of said rim and communicating with said beverage container interior; and a device for receiving saliva expectorated by a tobacco chewing individual and directing the saliva into the beverage container interior, said device including an open topped receptacle having an outlet and a connector releasably connecting said receptacle to said beverage container with said outlet in liquid flow communication with the opening defined by the top of said beverage container whereby saliva expectorated onto said receptacle will drain under the influence of gravity into said beverage container interior and additionally including a drain conduit attached to said receptacle and extending downwardly therefrom, said drain conduit extending into said beverage container interior and defining a liquid flow passageway in liquid flow communication with the outlet of said receptacle.

2. The combination according to claim 1 wherein said drain conduit has an open distal end located in said beverage can interior spaced from the bottom, the top and the side wall of said beverage container.

3. The combination according to claim 2 wherein said drain conduit is substantially rigid and defines an acute angle with the top of said beverage container.

4. The combination according to claim 1 wherein said receptacle includes an inclined inner wall surface leading to said outlet.

5. The combination according to claim 1 wherein said device is of integral construction and wherein said connector comprises an outer sleeve surrounding and frictionally engaging said rim.

6. The combination according to claim 5 wherein said device additionally comprises a manually graspable member extending outwardly from said sleeve to facilitate selective connection of said device to said beverage container or removal of said device from said beverage container.

7. The combination according to claim 4 wherein said beverage container comprises a beverage can, said opening being formed by prior removal of a snap top closure associated with said beverage can, said opening and the outlet of said receptacle being off center and disposed on one side of a longitudinal central axis of said beverage container, and the distal end of said drain conduit being at a location in the beverage can interior on a second side of said longitudinal central axis.

8. The combination according to claim 1 wherein said device is of integral, molded plastic construction.

9. The combination according to claim 1 wherein the cross-sectional configuration of at least a portion of the drain conduit substantially conforms to the shape of the opening in the beverage container top.

10. A device for use with a beverage container for receiving saliva expectorated by a tobacco chewing individual and directing the saliva into the beverage container, said beverage container including a side wall having an upper rim, a top attached to said upper rim, and a bottom, said top, said side wall and said bottom defining a beverage container interior, and said top defining an opening disposed inwardly of said rim and communicating with said beverage container interior, and said device including an open topped receptacle having an outlet and a connector for releasably connecting said receptacle to said beverage container with said outlet in liquid flow communication with the opening defined by the top of said beverage container whereby saliva expectorated onto said receptacle will drain under the influence of gravity into said beverage container interior, the device including a drain conduit attached to said receptacle and extending downwardly therefrom, said drain conduit for extending into said beverage container interior and defining a liquid flow passageway in liquid flow communication with the outlet of said receptacle, said drain conduit being substantially rigid and defining an acute angle with said receptacle.

11. The device according to claim 10 wherein said receptacle includes an inclined inner wall surface leading to said outlet.

12. The combination according to claim 10 wherein said device is of integral construction and wherein said connector comprises an outer sleeve for surrounding and frictionally engaging said rim.

13. The combination according to claim 12 wherein said device additionally comprises a manually graspable member extending outwardly from said sleeve to facilitate selective connection of said device to said beverage container or removal of said device from said beverage container.

14. The combination according to claim 10 wherein said device is of integral, molded plastic construction.

15. The combination according to claim 10 wherein the cross-sectional configuration of at least a portion of the drain conduit substantially conforms to the shape of the opening in the beverage container top.

* * * * *